US006439278B1

(12) United States Patent
Krasnov

(10) Patent No.: US 6,439,278 B1
(45) Date of Patent: Aug. 27, 2002

(54) COMPRESSED NATURAL GAS DISPENSING SYSTEM

(75) Inventor: Igor Krasnov, Houston, TX (US)

(73) Assignee: NEOgas Inc., Houston, TX (US)

( * ) Notice: Subject to any disclaimer, the term of this patent is extended or adjusted under 35 U.S.C. 154(b) by 0 days.

(21) Appl. No.: 09/811,020

(22) Filed: Mar. 16, 2001

(51) Int. Cl.[7] ..... F17C 13/02

(52) U.S. Cl. ..... 141/197; 141/5; 141/18; 141/47; 141/94; 141/95

(58) Field of Search ..... 141/2–5, 11, 12, 141/18, 21, 25, 27, 47, 51, 67, 83, 94, 95, 197, 248

(56) References Cited

U.S. PATENT DOCUMENTS 5,454,408 A * 10/1995 DiBella et al. ..... 141/197

5,884,675 A 3/1999 Krasnov ..... 141/18

* cited by examiner

*Primary Examiner*—Charles R. Eloshway
*Assistant Examiner*—Peter deVore
(74) *Attorney, Agent, or Firm*—Bracewell & Patterson, L.L.P.

(57) ABSTRACT

A compressed natural gas (CNG) refueling system has banks of cylinders containing CNG, a hydraulic fluid reservoir containing a hydraulic fluid which does not readily mix with CNG, and reversible flow valves. Each cylinder has a fitting installed in an opening at one end. The fitting contains a hydraulic fluid port and a gas port. The other end of each cylinder is closed. Hydraulic fluid is pumped from the reservoir into each cylinder through the hydraulic fluid port. Inside each cylinder, the hydraulic fluid directly contacts the CNG, forcing the CNG out through the gas port. When a sensor detects that the cylinders are substantially drained of CNG, the reversible flow valves will reverse orientation, allowing the hydraulic fluid to flow back into the reservoir.

17 Claims, 3 Drawing Sheets

COMPRESSED NATURAL GAS DISPENSING SYSTEM

TECHNICAL FIELD

This invention relates in general to natural gas and in particular to natural gas fuel delivery systems.

BACKGROUND OF THE INVENTION

Compressed natural gas (CNG) vehicles require specialized refueling delivery systems. U.S. Pat. No. 5,884,675 discloses one such system consisting of banks of cylinders each of which has an axially moveable piston, a pair of inlets, and an outlet. The cylinders are filled with CNG at a remote location and then transported to the refueling station. At the refueling station, hydraulic fluid is pumped from a reservoir into one end of each cylinder. The hydraulic fluid displaces the piston in each cylinder, forcing CNG through the outlet at the other end of the cylinder. The CNG flows through a hose into the vehicle being refueled. Each bank of cylinders is equipped with an accumulator located downstream from the outlets. When the cylinders are completely drained of CNG, the pressure in the accumulator moves each piston back to its starting position, forcing the hydraulic fluid out of the cylinders and back into the reservoir.

While this system represents an improvement over other CNG delivery systems, certain disadvantages remain. Each of the cylinders has a moveable piston and openings at each end, making them expensive to manufacture.

SUMMARY OF THE INVENTION

A compressed natural gas (CNG) refueling system has a hydraulic fluid reservoir containing hydraulic fluid, a pump, and reversible flow valves. The hydraulic fluid is of a type which does not readily mix with the CNG. The refueling system also includes cylinders containing CNG. Each cylinder has a fitting installed in an opening at one end. The fitting contains a hydraulic fluid port and a gas port. A tube extends within the cylinder from the hydraulic fluid port to a point adjacent to the opposite end of the cylinder. The opposite end of the cylinder is closed.

At the refueling station, hydraulic fluid is pumped from the reservoir through the hydraulic fluid port in each cylinder, displacing the CNG inside each cylinder and forcing the CNG out through the gas port of each cylinder. During fueling, hydraulic fluid is pumped from the reservoir to maintain 3600 psi of pressure in the cylinders. When a sensor detects that the cylinders are completely drained of CNG, the reversible flow valves will reverse orientation, allowing the hydraulic fluid to flow back into the reservoir. Once the cylinders are drained of hydraulic fluid, the cylinders may be disconnected and refilled with CNG.

DETAILED DESCRIPTION OF THE PREFERRED EMBODIMENT

Figure 1:
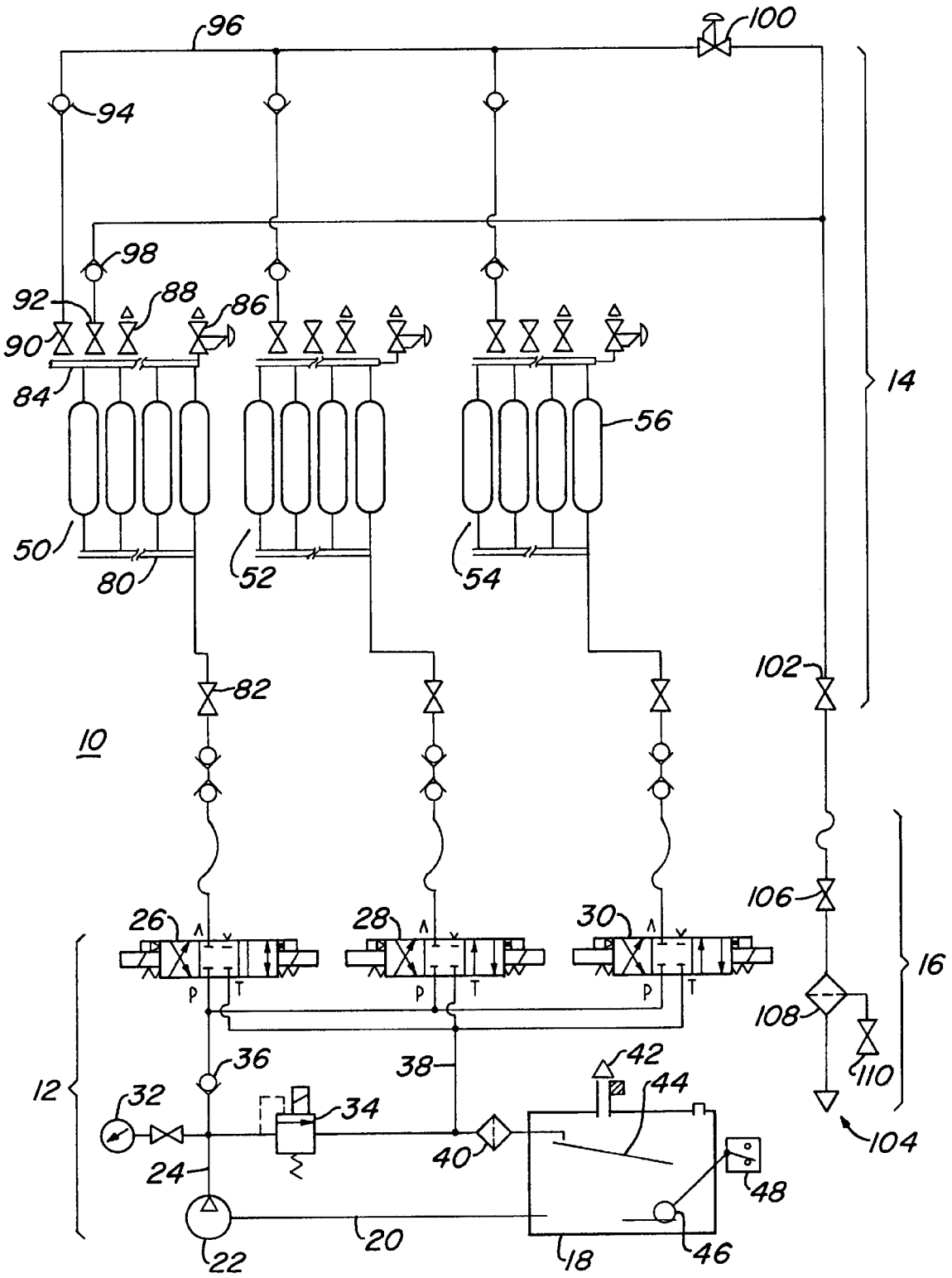
FIG. 1 is a schematic drawing of a compressed natural gas refueling system constructed in accordance with the invention.

Referring to FIG. 1, a compressed natural gas (CNG) refueling system 10 is shown. The refueling system 10 is divided into a control section 12, a transfer section 14, and a refueling section 16. Control section 12 has a control panel (not shown). Control section 12 also has a hydraulic fluid reservoir 18 containing a hydraulic fluid. The hydraulic fluid is a liquid that does not readily mix with CNG, such as a synthetic hydrocarbon hydraulic oil. One suitable type is manufactured under the name "Low Vapor 68" synthetic lubricant by O'Rourke Petroleum Products, Houston, Tex.

Reservoir 18 has an outlet line 20 leading to hydraulic fluid pump 22. Pump 22 has an outlet line 24 which leads to reversible flow valves 26, 28, 30. A pressure gage 32 monitors pressure in pump outlet line 28. Relief valve 34 in pump outlet line 28 is set to prevent pressure in excess of 3600 psi by bleeding the excessively pressurized fluid back into reservoir 18. Check valve 36 in pump is outlet line 24 allows hydraulic fluid to flow from pump 22 to flow valves 26, 28, 30. A return line 38 extends from flow valves 26, 28, 30 to reservoir 18. Return line 38 has a separator 40 to remove any trapped CNG from hydraulic fluid. Sensor 42 detects any trapped CNG and sends a signal to control panel if CNG is present. Separation mechanism 44 releases any CNG trapped within reservoir 18. Reservoir 18 also has an indicator 46, preferably a float type, which tracks the level of fluid in the reservoir. Indicator 46 is connected to transmitter 48 which provides a signal to the control panel when the fluid level in reservoir 18 reaches a selected lower level or upper level.

Figure 2:
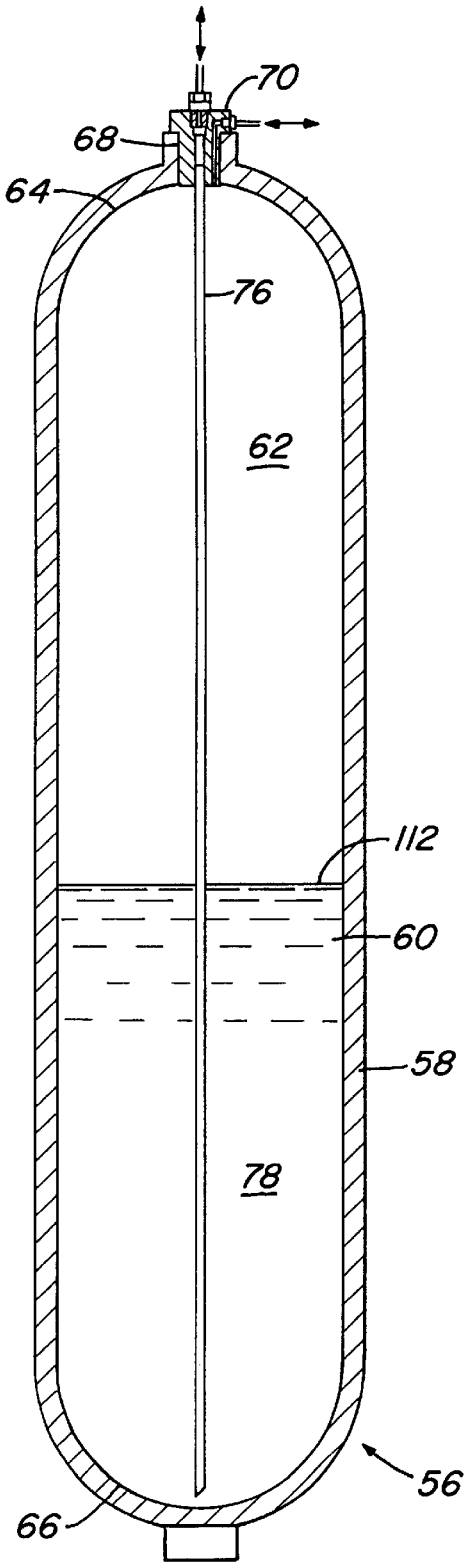
FIG. 2 is an enlarged sectional side view of one of the cylinders of FIG. 1.
Figure 3:
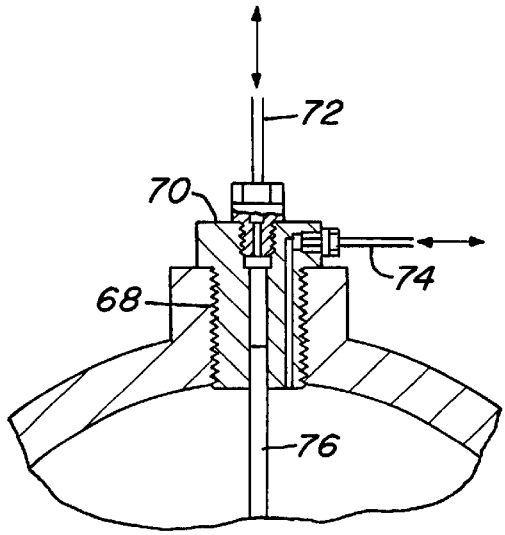
FIG. 3 is a partial enlarged sectional side view of the cylinder of FIG. 2, showing the fitting installed in one end of the cylinder.

Transfer section 14 comprises banks 50, 52, 54 of high pressure storage cylinders 56. Each bank 50, 52, 54 contains an equal number of cylinders 56 which are identical in size. As shown in FIG. 2, each cylinder 56 has a shell 58 and an internal chamber 60. Before delivery to the fueling station, the internal chamber 60 of each cylinder 56 is filled with pressurized CNG 62. Each cylinder 56 also has a first end 64 and a second end 66. Second end 66 is closed. First end 64 has an opening 68 through which passes a fitting 70. As shown in FIG. 3, fitting 70 contains a hydraulic fluid port 72 and a gas port 74. A hollow tube 76 extends within the chamber 60 from the hydraulic fluid port 72 to a point adjacent to second end 66 for introducing hydraulic fluid 78 into chamber 60.

Referring back to FIG. 1, the hydraulic fluid ports 72 of each cylinder 56 in a bank 50, 52, 54 are joined together in parallel by fluid manifold 80. Reversible flow valves 26, 28, 30 are located between pump 22 and fluid manifold 80. Each fluid manifold 80 has a manual shut-off valve 82. The gas ports 74 of each cylinder 56 in a bank 50, 52, 54 are joined together in parallel by gas manifold 84. Each bank 50, 52, 54 also has a pressure relief valve 86, a flare valve 88, and manual shut-off valves 90, 92 located downstream from the gas ports 74 in parallel. Pressure relief valve 86 prevents pressure in excess of 3600 psi by bleeding off the excessively pressurized CNG as it exits cylinders 56. Flare valve 88 allows the release of CNG from any bank 50, 52, 54 should bank 50, 52, 54 require service or repair. Manual shut-off valves 90, 92 allow isolation of any bank 50, 52, 54 for any reason. Check valve 94 allows CNG to flow downstream from gas manifold 84 to hose line 96. Check valve 98 allows CNG to flow upstream from hose line 96 back to gas manifold 84. A flow control valve 100 and manual shut-off valve 102 are located in hose line 96.

Refueling section 16 comprises at least one refueling depot 104. Each refueling depot 104 has a manual shut-off valve 106 and a filtering unit 108. Filtering unit 108 removes any trapped hydraulic fluid from the CNG stream before dispensing CNG. Filtering unit 108 has test cock 110 to check for the presence of hydraulic fluid in filtering unit 108.

In operation, banks 50, 52, 54 are drained one at a time. If bank 50 is drained first, manual shut-off valves 82, 90 of bank 50 are opened, and manual shut-off valve 92 of bank 50 is closed. Reversible flow valve 26 is configured to allow downstream flow from pump 22 to bank 50. Hydraulic fluid is pumped by pump 22 from reservoir 18 into fluid manifold 80, through fluid ports 72 and into cylinders 56 to maintain pressure at 3600 psi in cylinders 56 while CNG is being dispensed. As shown in FIG. 2, the hydraulic fluid 78 flows through hollow tube 76 into cylinder 56 at the end opposite fitting 70. The hydraulic fluid 78 directly contacts CNG 62 at interface 112 but does not mix with CNG 62. The CNG 62 flows out of cylinders 56 through gas ports 74, gas manifold 84, check valve 94 and hose 96 to refueling section 16. Flow control valve 100 limits the pressure in hose 96 to 3600 psi.

When bank 50 is substantially empty of CNG, the level of hydraulic fluid in reservoir 18 will have reached the selected lower level, which is sensed by floating indicator 46. Transmitter 48 will send a signal to the control panel. Manual shut-off valves 82, 90 of bank 50 will be closed, and manual shut-off valve 92 of bank 50 will be opened. Reversible flow valve 26 will be configured to allow upstream flow from fluid manifold 80. CNG in hose 96 will flow through check valve 98 back into cylinders 56. Residual CNG in cylinders 56 forces hydraulic fluid out of cylinders 56. Hydraulic fluid will return to reservoir 18 through return line 38. Separator 40 in return line 38 removes any CNG trapped in the hydraulic fluid.

When substantially all hydraulic fluid has been removed from cylinders 56, the level of hydraulic fluid in reservoir 18 will have reached the selected upper level, as detected by floating indicator 46. Transmitter 48 will send a signal to the control panel. Manual shut-off valves 82, 90 of bank 52 will be opened, and manual shut-off valve 92 of bank 52 will be closed. Reversible flow valve 28 will be configured to allow downstream flow to bank 52. Bank 52 will begin to dispense CNG in the same manner as bank 50.

Figure 4:
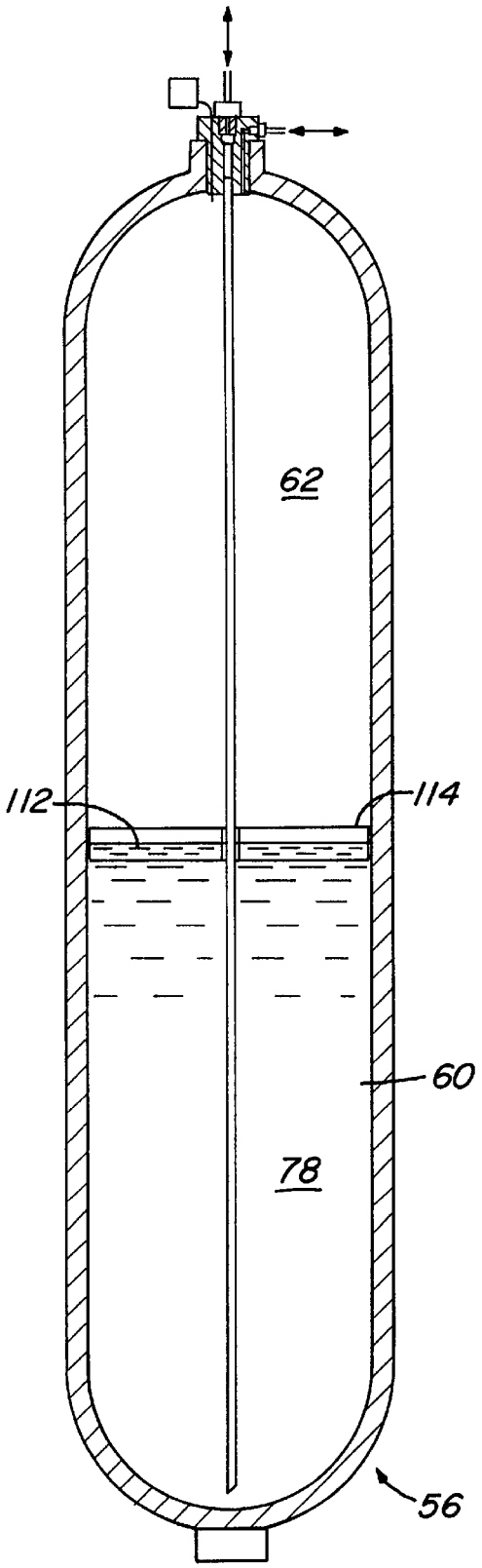
FIG. 4 is an enlarged sectional side view of one of the cylinders of FIG. 1, illustrating another embodiment of the invention.
Figure 6:
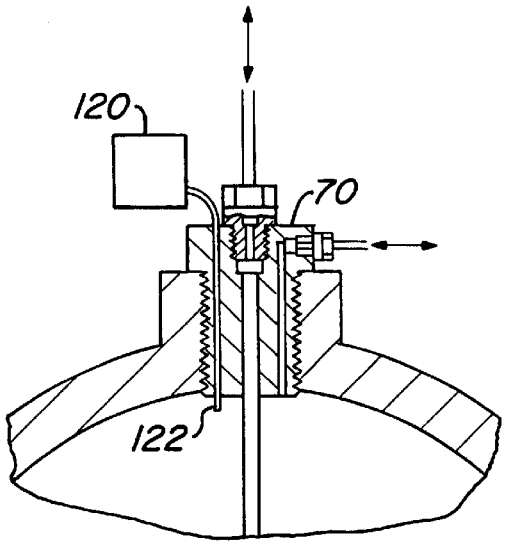
FIG. 6 is an enlarged portion of the cylinder of FIG. 4.
Figure 5:
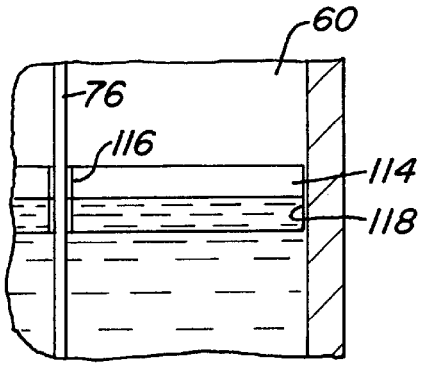
FIG. 5 is an enlarged sectional side view of a tracer disk installed in the cylinder of FIG. 4 in accordance with the invention.

Referring to FIGS. 4, 5, and 6, an alternate embodiment of the invention is illustrated. As shown in FIG. 4, tracer element 114 is positioned within the chamber 60 of cylinder 56. Tracer element 114 locates substantially at the interface 112 between CNG 62 and hydraulic fluid 78. Tracer element 114 is a flat plate or disc having a central opening 116 with a diameter slightly greater than the diameter of hollow tube 76. Tracer element 114 also has an outer edge 118 with a diameter slightly less than the diameter of chamber 60. Tracer element 114 is a thin, flexible member of a plastic or rubber that is impermeable to both hydraulic fluid 78 and CNG 62, and that contains a ferromagnetic powder. As shown in FIG. 6, a detector 120 has a probe extending through fitting 70 for sensing the proximity of tracer element 114 and providing a signal to the control 18 panel.

In operation, banks 50, 52, 54 are drained one at a time. If bank 50 is drained first, manual shut-off valves 82, 90 of bank 50 are opened, and manual shut-off valve 92 of bank 50 is closed. Reversible flow valve 26 is configured to allow downstream flow from pump 22 to bank 50. CNG 62 is forced out of chamber 60 by hydraulic fluid 78. As the amount of CNG 62 within chamber 60 decreases, interface 112 will move closer to fitting 70. Because tracer element 114 is not in contact with hollow tube 76 or chamber 60, tracer element 114 remains at interface 112, moving within chamber 60 as the level of CNG 62 changes.

When cylinder 56 is substantially empty of CNG 62, tracer element 114 will be at its closest point of approach to fitting 70. Detector 120 will sense the proximity of tracer element 114 and send a signal to the control panel. Reversible flow valve 26 will be configured to allow upstream flow from fluid manifold 80. CNG in hose 96 will flow through check valve 98 back into cylinders 56. Residual CNG in cylinders 56 forces hydraulic fluid out of cylinders 56. Hydraulic fluid returns to reservoir 18 through return line 38. Separator 40 in return line 38 removes any CNG trapped in the hydraulic fluid.

When substantially all hydraulic fluid has been removed from cylinders 56, tracer element 114 will be at the farthest point from fitting 70. Detector 120 will sense the location of tracer element 114 and send a signal to the control panel. Manual shut-off valves 82, 90 of bank 52 will be opened, and manual shut-off valve 92 of bank 52 will be closed. Reversible flow valve 28 will be configured to allow downstream flow to bank 52. Bank 52 will begin to dispense CNG in the same manner as bank 50.

It should be noted that in this alternate embodiment of the invention, tracer element 114 and detector 120 perform substantially the same function as floating indicator 46 and transmitter 48. Therefore, floating indicator 46 and transmitter 48 are not needed in this alternate embodiment, although they may be included if desired.

The invention has several advantages. Because the invention utilizes a hydraulic fluid which does not mix with the compressed natural gas, the cylinders may be manufactured without internal pistons or other mechanisms to keep the hydraulic fluid separate from the gas. Furthermore, because no piston is needed inside the cylinders, the fluid port and gas port can be installed in a single fitting which is located at one end of the cylinder. The other end of the cylinder can be closed. A cylinder which has no internal piston, and which is closed at one end, is significantly less costly to manufacture, and is likely to be more durable and have a longer useful life.

While the invention has been shown in only two of its forms, it should be apparent to those skilled in the art that it is not so limited, but is susceptible to various changes without departing form the scope of the invention.

I claim:

1. A fuel delivery system for delivering compressed natural gas into an external pressure vessel, comprising:

a reservoir having a pump intake line and a return line;

a hydraulic fluid contained in the reservoir;

at least one tank having a chamber containing a compressed natural gas, a gas port, and a hydraulic fluid port, each of which is in fluid communication with the gas stored in the chamber;

a hose line connected to the gas port for connection to an external pressure vessel; and a pump connected to the pump intake line for pumping the hydraulic fluid from the reservoir to the hydraulic fluid port and into physical contact with the gas stored in the chamber to maintain a selected minimum pressure at the gas port while the gas flows from the gas port through the hose line and into an external pressure vessel;

wherein the tank is elongated and has first and second ends; and wherein each of the ports extends through the first end and one of the ports comprises a tube leading within the chamber to a point adjacent to the second end.

2. The fuel delivery system of claim 1 wherein the hydraulic port is spaced within the chamber opposite the gas port for delivering the hydraulic fluid at a point in the chamber distant from the gas port.

3. The fuel delivery system of claim 1 wherein;

said one of the ports comprises the hydraulic fluid port.

4. The fuel delivery system of claim 1, further comprising;

a sensor that detects when substantially all of the gas has been expelled from the tank; and a valve that allows the hydraulic fluid in the chamber to flow back through the hydraulic fluid port into the reservoir.

5. The fuel delivery system of claim 4 wherein the sensor comprises a level indicator that monitors a level of the hydraulic fluid in the reservoir.

6. A fuel delivery system for delivering compressed natural gas into an external pressure vessel, comprising:

a reservoir having a pump intake line and a return line;

a hydraulic fluid contained in the reservoir;

at least one tank having a chamber containing a compressed natural gas, a gas port, and a hydraulic fluid port, each of which is in fluid communication with the gas stored in the chamber;

a hose line connected to the gas port for connection to an external pressure vessel; and a pump connected to the pump intake line for pumping the hydraulic fluid from the reservoir to the hydraulic fluid port and into physical contact with the gas stored in the chamber to maintain a selected minimum pressure at the gas port while the gas flows from the gas port through the hose line and into an external pressure vessel;

a valve that allows the hydraulic fluid to flow back into the reservoir after substantially all of the gas has been dispensed;

a sensor to detect the presence of gas in the hydraulic fluid being returned to the reservoir; and a separating mechanism to release any gas trapped in the hydraulic fluid being returned to the reservoir.

7. The fuel delivery system of claim 6 wherein the hydraulic fluid is of a type that will not mix with the gas.

8. A fuel delivery system for delivering compressed natural gas into an external pressure vessel, comprising:

a reservoir having a pump intake line and a return line;

a hydraulic fluid contained in the reservoir;

at least one tank having a chamber containing a compressed natural gas, a gas port, and a hydraulic fluid port, each of which is in fluid communication with the gas stored in the chamber;

a hose line connected to the gas port for connection to an external pressure vessel; and a pump connected to the pump intake line for pumping the hydraulic fluid from the reservoir to the hydraulic fluid port and into physical contact with the gas stored in the chamber to maintain a selected minimum pressure at the gas port while the gas flows from the gas port through the hose line and into an external pressure vessel;

a tracer member that locates substantially at an interface between the hydraulic fluid and the gas and moves with the hydraulic fluid as the gas is being expelled; and a detector that detects the presence of the tracer member when it is near the gas port, to indicate that the gas is substantially depleted.

9. The fuel delivery system of claim 8 wherein the tracer member is a thin, flexible disk.

10. The fuel delivery system of claim 9 wherein the disk contains ferromagnetic powder, and the detector comprises a magnetic sensor to detect the presence of the powder.

11. A fuel delivery system for delivering compressed natural gas into an external pressure vessel, comprising:

a reservoir having a pump intake line and a return line;

a hydraulic fluid contained in the reservoir;

at least one cylinder having a chamber containing a compressed natural gas, a first end, and a second end, the first end having an opening containing a fitting comprising a gas port and a hydraulic fluid port, each port adapted to be in fluid communication with the gas stored in the chamber, the hydraulic fluid port comprising a tube which leads within the chamber from the first end to a point adjacent to the second end, and the second end being closed;

a hose line connected to the gas port for connection to an external pressure vessel;

a pump connected to the pump intake line for pumping the hydraulic fluid from the reservoir to the hydraulic fluid port to maintain a selected minimum pressure at the gas port while the gas flows from the gas port through the hose line and into the external pressure vessel;

a sensor that detects when substantially all of the gas has been expelled from the cylinder; and a valve that allows the hydraulic fluid in the chamber to flow from the hydraulic fluid port through the return line and back into the reservoir.

12. The fuel delivery system of claim 11 wherein the sensor comprises a level sensor that monitors a level of the hydraulic fluid in the reservoir.

13. The fuel delivery system of claim 11 further comprising:

a sensor to detect the presence of gas in the hydraulic fluid being returned to the reservoir; and a separating mechanism to release any gas trapped in the hydraulic fluid being returned to the reservoir.

14. The fuel delivery system of claim 11 wherein the hydraulic fluid is of a type that will not mix with the gas.

15. The fuel delivery system of claim 11, further comprising:

a tracer member that locates substantially at an interface between the hydraulic fluid and the gas within the chamber and moves with the hydraulic fluid as the gas is being expelled; and a detector that detects the presence of the tracer member when it is near the gas port, to indicate that the gas is substantially depleted.

16. The fuel delivery system of claim 15 wherein the tracer member is a thin, flexible disk.

17. The fuel delivery system of claim 16 wherein the disk contains ferromagnetic powder and the detector comprises a magnetic sensor to detect the presence of the powder.

* * * * *